US006386942B1

(12) United States Patent
Tang

(10) Patent No.: US 6,386,942 B1
(45) Date of Patent: May 14, 2002

(54) TOY'S EYEBROW AND MOUTH MOVING MECHANISM

(76) Inventor: Tai-Ning Tang, 581 Kamoku St. #3506, Honolulu, HI (US) 96826

( * ) Notice: Subject to any disclaimer, the term of this patent is extended or adjusted under 35 U.S.C. 154(b) by 0 days.

(21) Appl. No.: 09/696,236

(22) Filed: Oct. 26, 2000

(51) Int. Cl.[7] ..... A63H 13/00; A63H 3/28; A63H 3/48

(52) U.S. Cl. ..... 446/301; 446/342; 446/353; 40/416

(58) Field of Search ..... 40/416; 446/301, 446/342, 353

(56) References Cited

U.S. PATENT DOCUMENTS

| | | | | |
|---|---|---|---|---|
| 754,825 A | | 3/1904 | Spencer et al. | |
| 4,721,437 A | | 1/1988 | Mitamura et al. | |
| 4,805,328 A | | 2/1989 | Mirahem | |
| 4,850,930 A | * | 7/1989 | Sato et al. | 446/301 X |
| 4,864,607 A | * | 9/1989 | Mitamura et al. | 446/301 X |
| 4,900,289 A | | 2/1990 | May et al. | |
| 5,855,502 A | | 1/1999 | Truchsess | |
| 5,966,853 A | * | 10/1999 | Yeh | 40/416 |
| 5,983,542 A | * | 11/1999 | Chen | 40/416 X |
| 6,053,798 A | * | 4/2000 | Tang | 446/301 |

FOREIGN PATENT DOCUMENTS

| | | |
|---|---|---|
| GB | 2198363 | 6/1988 |
| TW | 316488 | 9/1997 |

* cited by examiner

*Primary Examiner*—John A. Ricci
(74) *Attorney, Agent, or Firm*—Rabin & Berdo, P.C.

(57) ABSTRACT

This invention relates to a toy's eyebrow and mouth moving mechanism, involving a base on which is fixed a stand and a main unit that accommodates the integral mechanism of this invention, on one side of the main unit is a motor which rotation can be switched on and off by a control circuit that is installed inside the base, the motor driving an eyebrow unit that is located at the upper part of the main unit, through a medium gear, an upper reducing gear and an upper activating gear, the motor also driving a lower jaw unit that is located at the lower part of the main unit, in such a construction, when the power of this invention is switched on, the control circuit will activate melodic music and flashing light (the lamp installed inside the eyeball), on the other hand the motor will activate the eyebrows and mouth to blink and move according to the music and rhythms, thus providing lively and amusing effects, and because of its more simplified construction than the prior art of the same category, this invention will effectively reduce production costs and enhance market competitiveness.

1 Claim, 5 Drawing Sheets

TOY'S EYEBROW AND MOUTH MOVING MECHANISM

BACKGROUND OF INVENTION

This invention relates to a toy's eyebrow and mouth moving mechanism, and particularly to a structural improvement involving a single motor and simplified transmission construction that synchronizes the eye blinking and mouth moving performance with music rhythms, providing lively amusement, effectively reducing production costs and enhancing market competitiveness.

With information flow in modern days, many cultural, art, physical education and religious activities that were considered regional have become worldwide activities, such as Christmas, which has become a festival shared by all corners around the globe. In Christmas activities, in order to enjoy the festival, proper indoor decoration is essential. The Christmas tree is a major decoration. Generally, an artificial tree would be used, with flashing lights and small decorations hanging and winding on the Christmas tree. Since such a traditional Christmas tree has only static decorative function, they appear monotonous. For that reason, variations in the design of the Christmas tree have been proposed. To enable dynamic functions to the Christmas tree, a conventional construction can be exemplified by U.S. Pat. No. 5,855,502 "Animated characters utilizing face unit mechanism and control system", which comprises:

An erected support structure;

A face unit installed on the main unit of said support structure, said face unit including a face member composed of two pivoting eye components and a mouth unit with a movable lower lip component, all operation of the components being created by the electric-driven face unit installed on the face member;

A speaker installed below said support structure face member;

A control circuit installed in said support structure, creating singing and voices;

A power source to activate said support structure and control circuit to create the face members of eyes and mouth components to create synchronized singing and voices.

The eye and mouth movement in the patent must respectively be driven by two motors and different transmission mechanisms. Because it must use two motors and complicated mechanisms, its assembly is quite troublesome, and its material and assembling costs are quite high, which results in a higher trouble rate.

SUMMARY OF INVENTION

In view of that problem, the inventor has aimed at improving on the shortcomings of conventional dynamic Christmas tree toys, and based on many years of experience in the research and production of related toy products, and has successfully come up with the "toy's eyebrow and mouth moving mechanism" using only one motor and simplified transmission mechanism to successfully enable the eye to blink and the mouth to move to the rhythm of music, to effectively reduce production costs, achieving such features as saving power, increased durability, low trouble rate, etc.

BRIEF DESCRIPTION OF DRAWINGS

The drawings of preferred embodiments of this invention are described in details as follows to enable a better understanding.

DETAILED DESCRIPTION OF PREFERRED EMBODIMENTS

Figure 1:
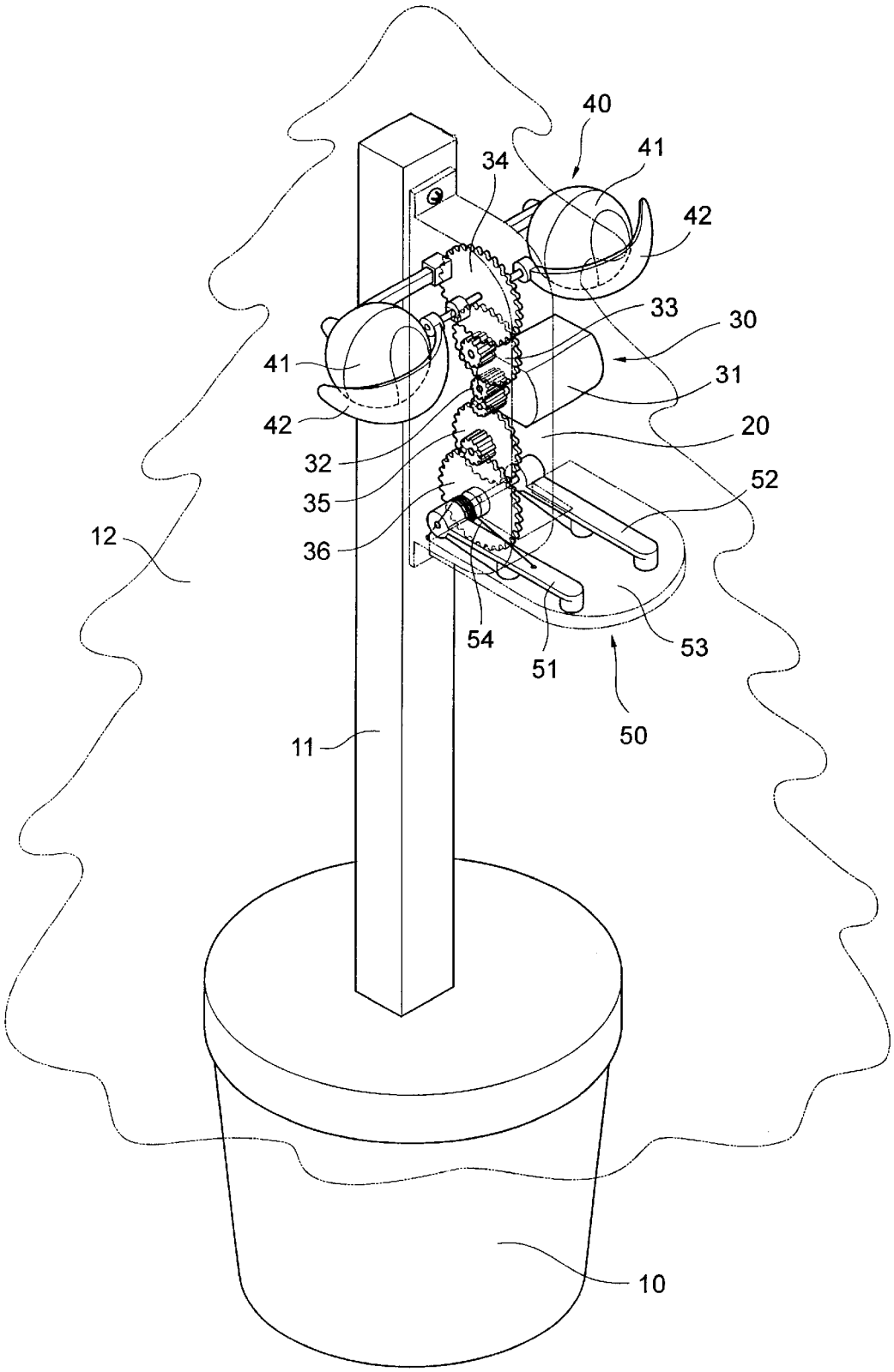
FIG. 1 is a perspective view of a preferred embodiment of this invention as it is applied to a Christmas tree.
Figure 2:
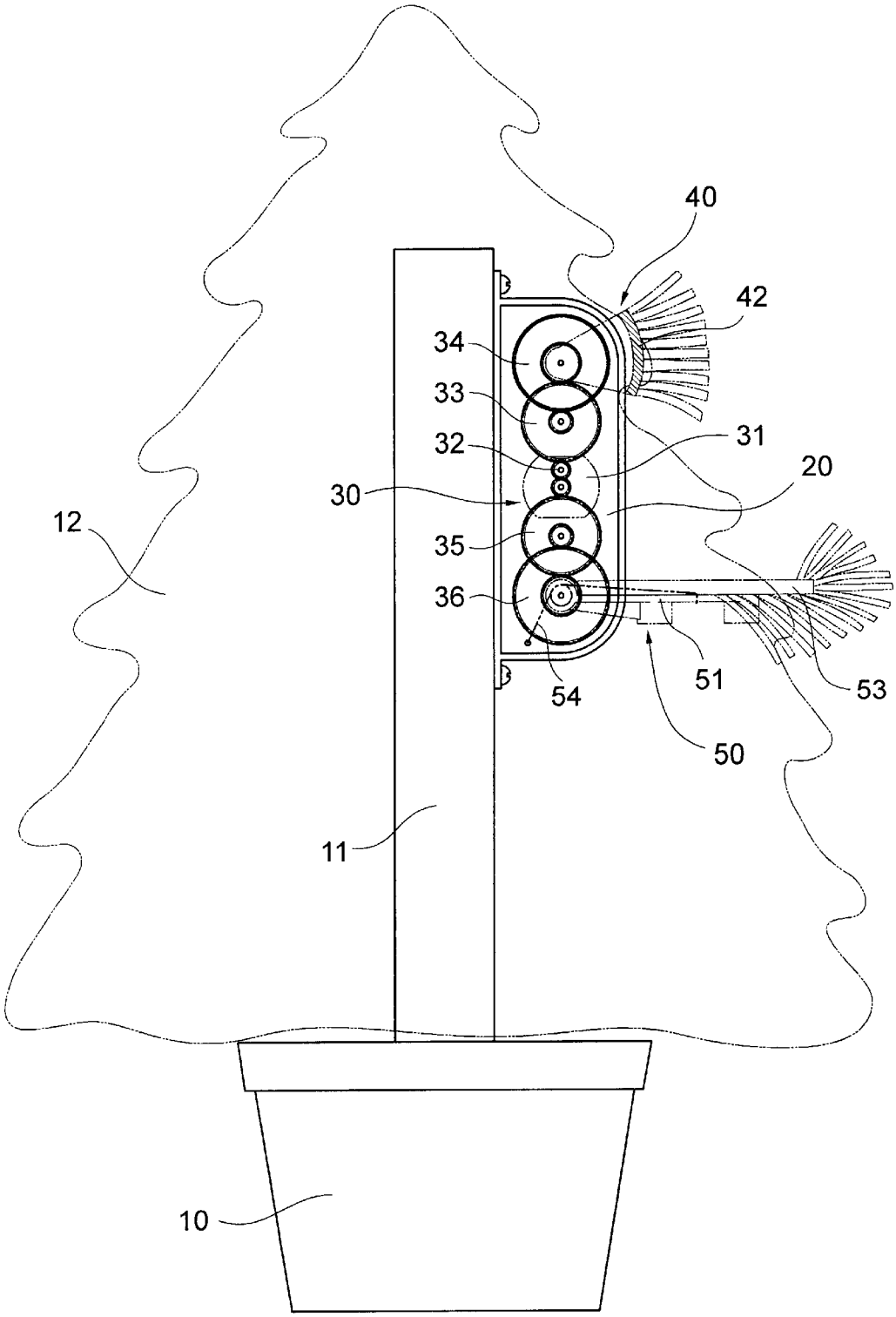
FIG. 2 is a schematic view of the closed status of the eyebrow units and the jaw unit of this invention in the embodiment of a Christmas tree.
Figure 3:
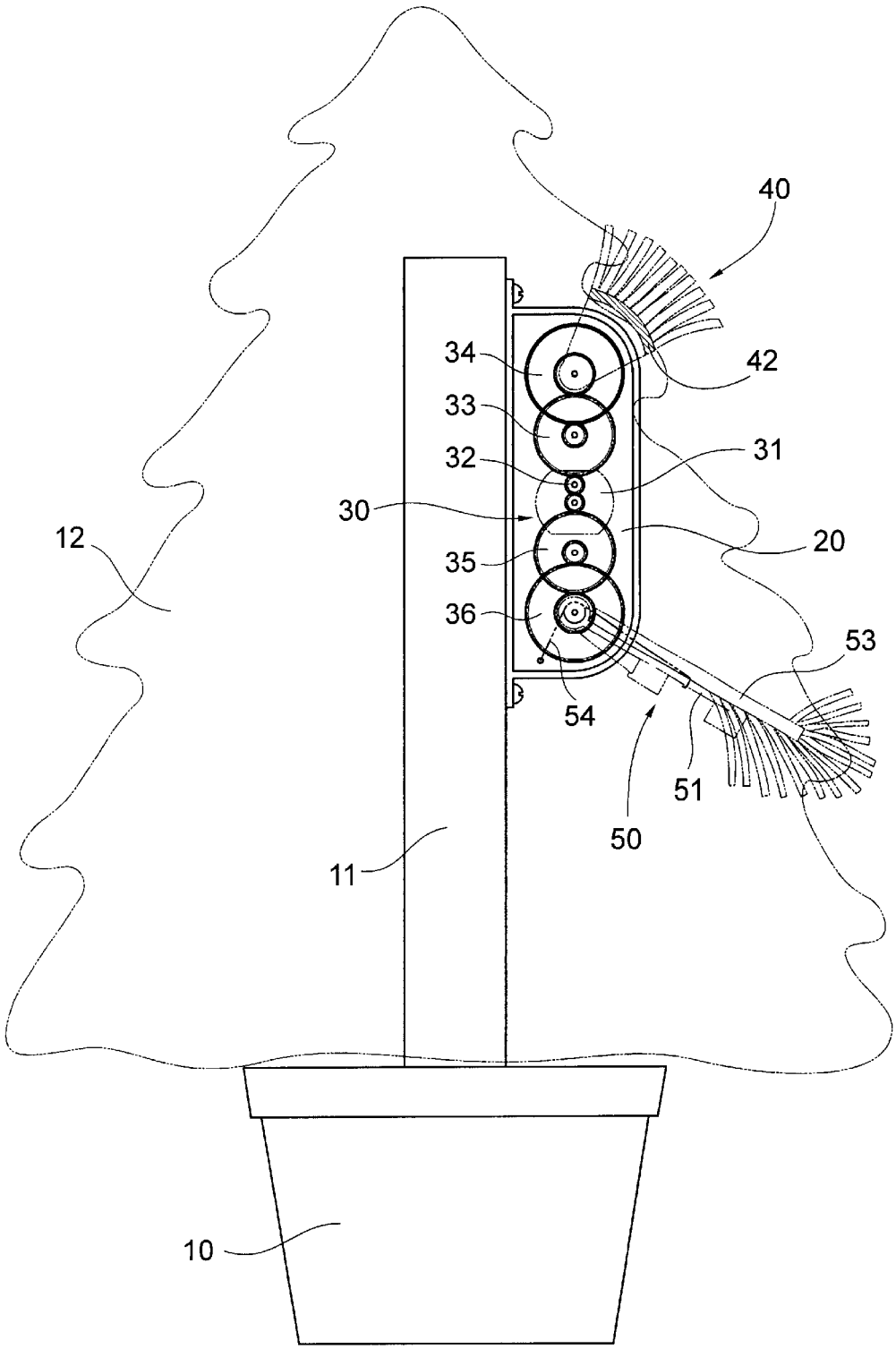
FIG. 3 is a schematic view of the opened status of the eyebrow units and the jaw unit of this invention in the embodiment of a Christmas tree.

Please refer to FIGS. 1, 2 and 3 (showing this invention in the embodiment of a Christmas tree toy). On a base 10 is a stand 11 to which is fixed main unit 20 accommodating the integral installation of this invention. Attached to the outside of the stand 11 and the main unit 20 is a cover of branches and leaves 12 to compose a Christmas tree. The base 10 accommodates the installation of a battery and a power switch, or a chip giving off music signal pulses, as well as a control circuit to switch on and off a motor 31 and a flashing LED (installed inside the eyeball 41). Since such circuit configuration is not one of the structural characteristics of this invention, it is not elaborated here. The structural characteristics of this invention include the following:

A transmission device 30: installed inside the main unit 20, including a motor 31 that is installed on one side of the main unit 20 and is turned on or off by the aforementioned control circuit. The motor drives an upper activating gear 34 through a medium gear 32 and an upper reducing gear 33, and a lower activating gear 36 through a lower reducing gear 35.

An eyebrow unit 40: installed on an upper part of the main unit 20 are two eyeballs 41 that are respectively fixed on two sides of the main unit 20, and two eyebrow plates 42 that are fixed to two ends of the axle of the upper activating gear 34. The two eyebrow plates are located on two sides of the main unit 20 and on the front of the eyeballs 41. The surfaces of the plates have leaves glued thereto to compose the shape of eyebrows. The plates rotate at specified angles with the upper activating gear 34 to create the movement of the eyebrows.

A lower jaw unit 50: installed at the lower part of the main unit 20, are two support plates 51, 52 that are respectively fixed to two ends of the axle of the lower activating gear 36. The tops of the two support plates 51, 52 are jointly tightened by a lower jaw plate 53. On the shaft on one side of one of the support plates 51 is a spring 54. One end of the spring 54 is inserted into the side of the main unit 20, and the other end of the spring 54 is inserted into the support plate 51. The lower jaw plate 53 is maintained at a level state by the support of the spring 54. Leaves can be glued to the surface of the lower jaw plate 53 to make it look like beard.

In such a construction, before it is switched on, the integral exterior of this embodiment looks like a Christmas tree with a face. When we turn on the switch installed inside the base 10, the control circuit sends out Christmas carols through a chip, driving the LED inside the eyeball 41 to flash on and off. Meanwhile, the music signal pulses will accompany the music rhythm and drive the motor 31 to switch on and off its rotation. When the motor 31 is switched on to rotate, it drives the upper activating gear 34 and the lower activating gear 36 to rotate at specified angles. Then the lower activating gear 34 will drive the two eyebrow plates 42 to lift upward, and the lower activating gear 36 will drive the support plates 51, 52 which in turn will drive the lower jaw plate 53 to lift downward. As shown in FIG. 3, when this eyebrow plate 42 lifts upward and the lower jaw plate 53 lifts downward, the spring 54 is pushed by the support plate 51 to recoil and accumulate its stretching resiliency; when the motor 31 is switched off by the control circuit, the spring 54 stretches out because of the loss of compressing strength, so it will drive the support plate 51 to turn up the lower jaw plate 53. Meanwhile, it will also reset the upper eyebrow plate 42 down to its original position (to the status shown in FIG. 1) due to the linked mechanism of the gears (including the gear of the motor 31). By such a simplified but accurate dynamic transmission mechanism, the eyes (eyebrow unit 40) and mouth (lower jaw unit 50) on the face of the Christmas tree will blink and open and shut to match the rhythms of Christmas carols, and with the addition of a flashing LED on the eyeball 41, the toy looks like a Grandpa Christmas Tree singing Christmas songs while blinking his eyes and moving his mouth. It provides dynamic and amusing effects.

Figure 4:
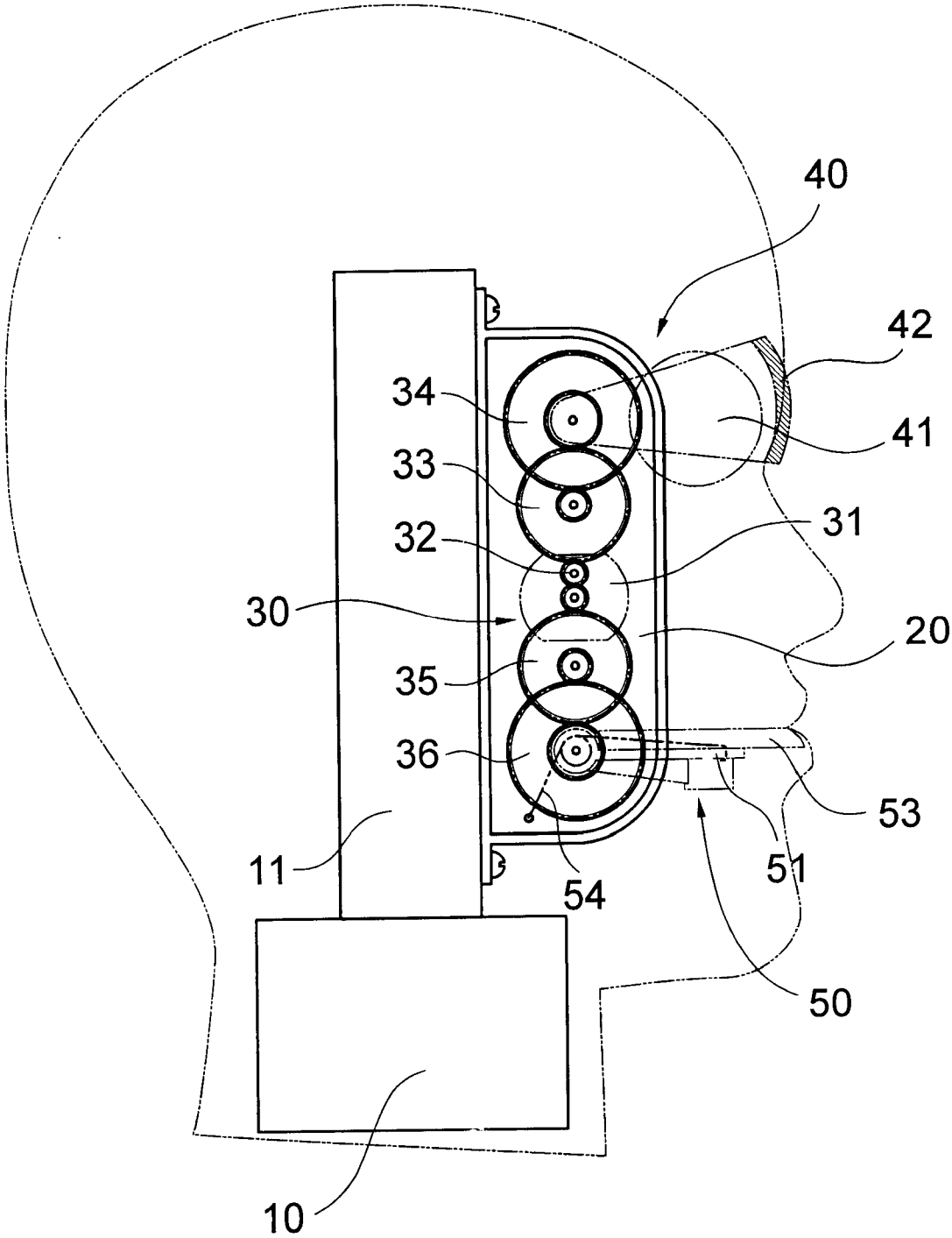
FIG. 4 is a schematic view of the closed status of the eyebrow units and the jaw unit of this invention as it is applied to a toy shaped like a human head.
Figure 5:
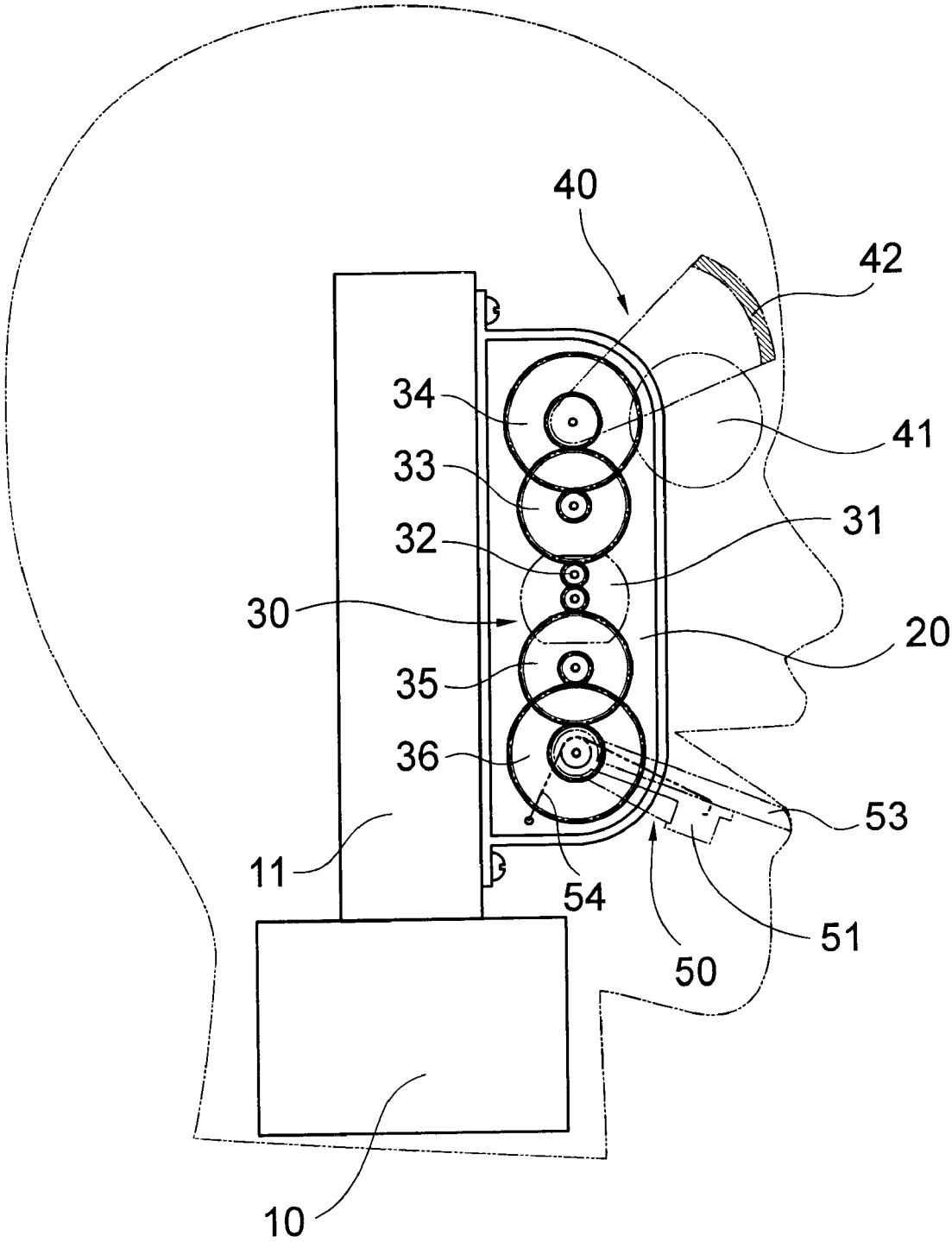
FIG. 5 is a schematic view of the opened status of the eyebrow units and the jaw unit of this invention as it is applied to a toy shaped like a human head.

Please refer to FIGS. 4 and 5. Without changing its structural characteristics, this invention can be applied to various toy configurations by modifying the locations and sizes of related components such as the stand 11, the eyeball 41, the eyebrow plate 42, the support plate 51, the lower jaw plate 53, etc. to coordinate with the shapes and measurements of the theme toy, such as the embodiment of a human head as shown in FIGS. 4 and 5; when the control circuit installed in the base 10 is activated by the chip to send out voices or singing words, on the one hand it will drive the LED inside the eyeball 41 to flash on and off, and on the other hand the voice or song's signal pulses will switch on and off the rotation of the motor 31, thereby driving the two eyebrow plates 42 to lift upward and the lower jaw plate 53 to lift downward. The resiliency of the spring 54 will reset them to their original positions, thus creating a performance of eyes blinking and mouth moving on the face of a human head to accompany the voices or musical rhythms.

Based on the above description, this invention has the following features:

(1) Simplified construction, using only one motor and an appropriate number of gear sets to accomplish lively performance, reasonable and appropriate structural design, accurate dynamic transmission, easy assembly, high production efficiency, effective reduction of material costs and labor costs, and drastic enhancement of competitiveness on the market.

(2) Use of only one motor and simplified transmission device, consuming low power, battery set of same quantity and voltage, this invention has longer use performance to satisfy economical efficiency; and because of simplified transmission mechanism, accurate and smooth power transmission, trouble can be minimized to ensure excellent and extended use performance.

(3) It can be applied to the face and head of a variety of dynamic toys, enabling lively and active facial expressions to the toy, effectively enhancing amusement and fun.

To conclude, the innovated'structural design of this invention will not only effectively overcome the problems in conventional toys of the same category, but will also achieve the above features. With the inventive step, improvement and industrial applicability of this invention, this application is duly filed. Your favorable consideration will be appreciated.

What is claimed is:

1. An eyebrow and mouth mechanism for a toy, comprising:

a main unit;

a transmission arrangement, including:

an upper activating gear having an axle;

an upper reducing gear in engagement with said upper activating gear;

a medium gear in engagement with said upper reducing gear;

a lower activating gear having an axle;

a lower reducing gear in engagement with said lower activating gear; and a motor installed on a side of said main unit and being adapted to be turned on or off by a control circuit, the motor driving said upper activating gear through said medium gear and said upper reducing gear, and driving said lower activating gear through said lower reducing gear;

an eyebrow unit installed on an upper part of said main unit, and including:

two eyeballs that are respectively fixed on opposite sides of said main unit; and two eyebrow plates that are fixed to two ends of said axle of said upper activating gear and that are adapted to simulate eyebrows, said two eyebrow plates being located in front of said eyeballs, said two eyebrow plates rotating at specified angles with said upper activating gear to create an upward and downward lifting movement of eyebrows; and a lower jaw unit installed at a lower part of said main unit, and including:

two support plates, each having a shaft that is fixed to a respective end of the axel of said lower activating gear;

a lower jaw plate fastened to said two support plates; and a spring disposed around one of said shafts, and having one end inserted into the side of said main unit, and having another end inserted into one of said support plates, said lower jaw plate being maintained at a level state by a support of said spring;

wherein when said motor is activated by the control circuit, said upper activating gear and said lower activating gear are rotated at specified angles, said upper activating gear and said lower activating gear in turn driving said eyebrow plates and said lower jaw plate to open, and when said motor is deactivated, a resiliency of said spring causes said eyebrow plates and said lower jaw plate to close.

* * * * *